US006701533B2

(12) United States Patent
Webb

(10) Patent No.: US 6,701,533 B2
(45) Date of Patent: Mar. 9, 2004

(54) HOCKEY SOCK ATTACHMENT DEVICE

(75) Inventor: Jerry W. Webb, Shoreview, MN (US)

(73) Assignee: Pro Guard Sports Incorporated, Roseville, MN (US)

( * ) Notice: Subject to any disclaimer, the term of this patent is extended or adjusted under 35 U.S.C. 154(b) by 31 days.

(21) Appl. No.: 09/991,436

(22) Filed: Nov. 21, 2001

(65) Prior Publication Data

US 2003/0093852 A1 May 22, 2003

(51) Int. Cl.[7] ..... A41F 19/00
(52) U.S. Cl. ..... 2/303; 2/228
(58) Field of Search ..... 2/306, 300, 302, 2/303, 304, 338, 311, 312, 240, 227, 228, 79, 920, 239

(56) References Cited

U.S. PATENT DOCUMENTS 775,979 A * 11/1904 Wilson ..... 301/64.303
1,814,511 A * 7/1931 Hebner ..... 2/306
1,970,129 A * 8/1934 Martinez ..... 24/388
2,617,990 A * 11/1952 Allard ..... 450/155
3,501,774 A * 3/1970 Norman ..... 2/321
4,811,427 A * 3/1989 Regan ..... 2/466
5,353,441 A * 10/1994 Lazorchak ..... 2/303
5,608,915 A * 3/1997 Libit ..... 2/228

* cited by examiner

*Primary Examiner*—Tejash Patel
(74) *Attorney, Agent, or Firm*—Dorsey & Whitney LLP

(57) ABSTRACT

An attachment device for connecting a hockey sock to a hockey short including a first attachment member fixed to a hockey short, a second attachment member selectively connectable to the first attachment member and a hockey sock connection member which is fixed to the second attachment member and selectively connectable to a hockey sock.

12 Claims, 2 Drawing Sheets

HOCKEY SOCK ATTACHMENT DEVICE

BACKGROUND OF THE INVENTION

1. Field of the Invention

The present invention relates generally to the field of hockey equipment and more particularly to a device for supporting hockey socks relative to a hockey short or other support member.

2. Summary of the Prior Art

A variety of means have been used by hockey players to keep their hockey socks from falling down during play. Some of these means include tape or Velcro, elastic or other straps wrapped around the sock and shin guard. Other means support the sock along its top edge. These other means have included providing a Velcro patch on the front surface of a hockey short, with the inside top edge of the sock connected directly to the Velcro patch, or providing a garter belt having garter clips permanently attached to the belt which are in turn connectable with the top edge of the sock.

While these prior means are acceptable to varying degrees, there is a need for an improved hockey sock attachment and support device which is readily and economically replaceable, if needed, and which provides secure support of the hockey sock.

SUMMARY OF THE INVENTION

The present invention provides a hockey sock attachment device, sometimes also referred to as a garter clip, which is readily and selectively connectable to and disconnectable from both a hockey short or other support member as well as the hockey sock itself. This device is readily and economically replaceable and provides the desirable degree of support for the hockey sock.

More specifically, the invention includes the combination of a first attachment member which is fixedly secured to a hockey short, a garter belt or the like. A second element of the combination includes a second attachment member which has one end which is selectively connectable to the first attachment member and a second end which is selectively connectable to a hockey sock.

A further embodiment of the device of the present invention includes a second attachment member which is provided with an elastic connection link extending between the first and second ends of the second attachment member. A still further embodiment of the invention includes a second attachment member which is provided with a garter clip at the second end of the second attachment member for selective connection to the upper edge of a hockey sock.

Accordingly, it is an object of the present invention to provide an improved hockey sock attachment and support device.

Another object of the present invention is to provide a hockey sock attachment device which is selectively connectable both to a hockey short, a garter belt or the like as well as to a hockey sock.

A further object of the present invention is to provide a system for selectively connecting a hockey sock to a hockey short or the like.

These and other objects of the present invention will become apparent with reference to the drawings, the description of the preferred embodiment and the appended claims.

DESCRIPTION OF THE DRAWINGS

FIG. 4 is an isometric view of a further embodiment of an attachment member for connection to a hockey short or the like.

DESCRIPTION OF THE PREFERRED EMBODIMENT

Figure 1:
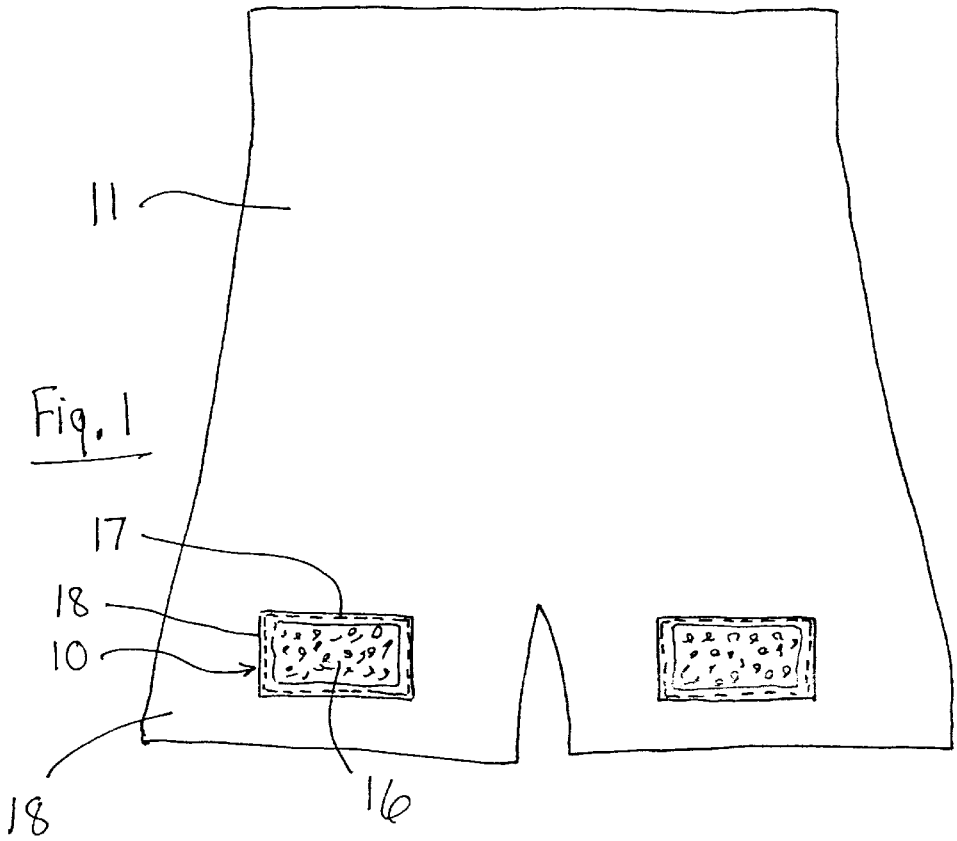
FIG. 1 is a front elevational view of a hockey short embodying attachment members.

Reference is first made to FIGS. 1, 2, 3 and 8 showing a first embodiment of the hockey sock attachment or support device of the present invention and its association with a hockey short. As shown best in FIGS. 1, 2 and 3, the hockey sock attachment or support device and system generally includes a first attachment member 10 which is fixed to a hockey short 11, or the like and a second attachment member 12 which is selectively connectable both to the first attachment member 10 and to a hockey sock 13 (FIG. 8) via the connection member 14.

The first attachment member 10 includes a backing portion 15 and a central Velcro or other connection element 16 centrally positioned on the backing member 15. In the preferred embodiment as shown in FIG. 1, an attachment member 10 is fixed to the front surface of a hockey short or the like at a point near the lower edge of each leg 18. This connection is preferably made by stitching 17 or some other substantially permanent connection means. In the embodiment of FIG. 1, the attachment member 10 and the Velcro portion 16 are shown as having a generally rectangular configuration; however, a variety of alternate configurations may be utilized as well without deviating from the spirit of the present invention.

Figure 8:
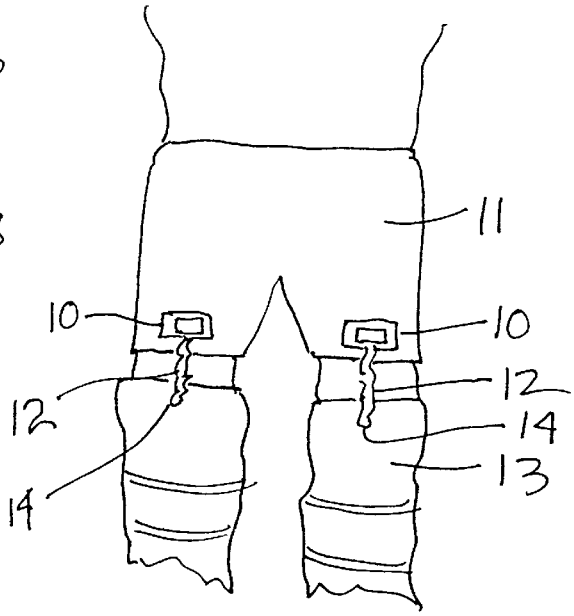
FIG. 8 is a front elevational view of a hockey player showing use of the hockey sock attachment device of the present invention.

The hockey short 11 shown in FIGS. 1 and 8 is a conventional hockey short known to those skilled in the art. The invention has particular application to such a hockey short with the first attachment member 10 fixed thereto; however, application of the present invention is not limited to use with a conventional hockey short. Specifically, any other type of garment worn by the hockey player may perform a function similar to that of the hockey short such as a garter belt or the like which includes a portion for supporting the first attachment member 10. Accordingly, unless otherwise stated herein, use of the term "hockey short" shall also mean a garter belt or some other garment worn by the hockey player which is capable of supporting the first attachment member 10.

The connection element 16 can comprise any attachment means known in the art by which two elements or members can be readily connected to and disconnected from one another. In the preferred embodiment, the attachment portion 16 is comprised of one half of a hook and loop attachment material such as the material commonly referred to by the trademark Velcro. However, it is contemplated that other similar attachment means are available and can be used as well. Although either half of the Velcro attachment material can be associated with the first attachment member 10, preferably, the connection element 16 is comprised of the male portion of the Velcro material.

Figure 2:
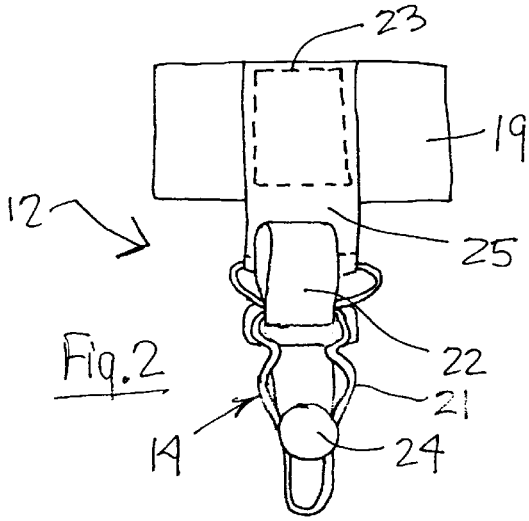
FIG. 2 is a front elevational view of a hockey sock attachment device of the present invention.
Figure 3:
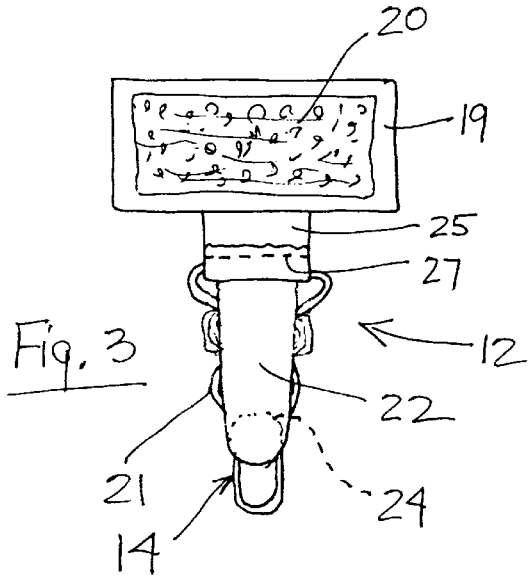
FIG. 3 is a rear elevational view of a hockey sock attachment device of the present invention.

The second attachment member 12, shown best in FIGS. 2 and 3, includes a first attachment end comprising an attachment portion for selective attachment to the connection element 16 of the member 10 and an opposite second attachment end having an attachment portion for selective connection to the upper edge portion of a hockey sock 13 (FIG. 8).

The attachment portion at the first attachment end of the attachment member 12 includes a backing material 19 and a connection element 20 secured to or formed on the inside surface of the backing material 19 as shown in FIG. 3. The connection element 20 is centrally positioned within the backing material 19 so that a peripheral edge of the backing material extends around the connection element 20. Like the connection element 16, the connection element 20 can comprise any material or attachment means for selectively connecting the second attachment member 12 to the first attachment member 10. In the preferred embodiment, the connection element 20 is comprised of a hook and loop attachment material such as Velcro, with the connection element 20 being the opposite (male/female) as the connection element 16. Preferably, with the connection element 16 being the male half of Velcro material, the connection element 20 is constructed of the female half of Velcro material. Although shown as being rectangular, the first attachment end of the attachment member 12 may be any configuration. Preferably, the configuration of the first attachment end connecting portion is similar to that of the first attachment member. Although FIG. 3 shows the Velcro portion 20 as being smaller than the backing material 19, the portion 20 can be the same size as the backing member 19.

The second attachment end of the member 12 may be comprised of any connection element which can be selectively and readily connected to and disconnected from a hockey sock. In the preferred embodiment, this connection element is a conventional garter clip 14 having a preformed wire frame 21, a plastic or other material strap 22 and a sock attachment button 24. The strap 22 is supported by the wire frame 21 in a conventional manner so that the strap is freely moveable relative to the frame 21. The button 24 is adapted for selective engagement with a lower portion of the wire frame 21 to attach the sock to the clip 14. Although the garter clip 14 is shown as the preferred connection member, any other connection member known in the art which may be readily connected to and disconnected from a hockey sock may be utilized.

The connection element or garter clip 14 may be directly connected to the first attachment end, and specifically the backing material 19, or can be connected, as shown in FIGS. 2 and 3, via an intermediate attachment link 25. In the embodiment shown in FIGS. 2 and 3, the intermediate attachment link 25 includes one end fixed to a portion of the backing material 19 such as by stitching 23 (FIG. 2) or the like, and a second, opposite end connected with the sock connection element 14. Specifically, the link 25 is connected to a portion of the wire frame 21 of the garter clip by extending an end of the link 25 around a portion of the frame and then connecting the link 25 by stitching 27. The attachment link can be constructed of a variety of materials; however, preferably the material is an elastic material. Thus, in the preferred embodiment, the elastic attachment link 25 is securely connected to, and extends between both the backing material 19 and the frame 21 of the garter clip 14.

Figure 4:
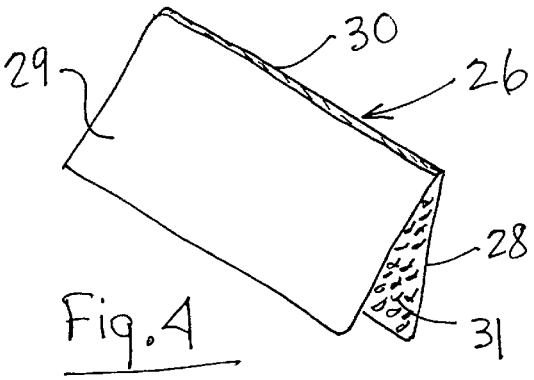
Figure 5:
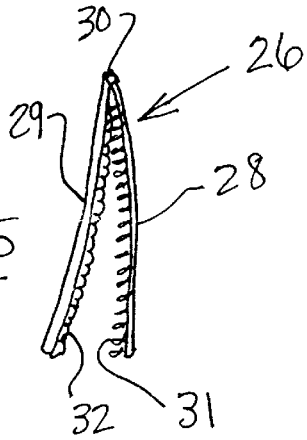
FIG. 5 is an end elevational view of the attachment member of FIG. 4.

A further embodiment 26 of the first attachment member which is fixedly secured to the hockey short or the like is shown in FIGS. 4 and 5. This further embodiment 26 includes a hockey short attachment member 28 designed for fixed connection to a hockey short 11 or the like and an attachment member flap or cover member 29. As shown, the attachment member 28 and the flap or cover 29 are joined to one another along a top edge 30. Thus, the flap or cover 29 is hingedly connected to the attachment member 28 along the edge 30. Like the attachment member 10, the attachment member 28 is fixedly secured to a hockey short by stitching or the like. The outer surface of the member 28 includes one-half of a connection material such as a hook and loop material 31. The inner side surface of the flap or cover 29 also includes one-half of a connection material such as a hook and loop connection material 32. Preferably, the materials 31 and 32 are opposite halves of Velcro material with the material 31 preferably being the male half and the material 32 being the female half.

When the hockey sock is not attached to the attachment member 26, the connection materials 31 and 32 are connected with one another. This prevents such materials from picking up lint or other materials when the hockey shorts are being cleaned or otherwise not in use.

Figure 6:
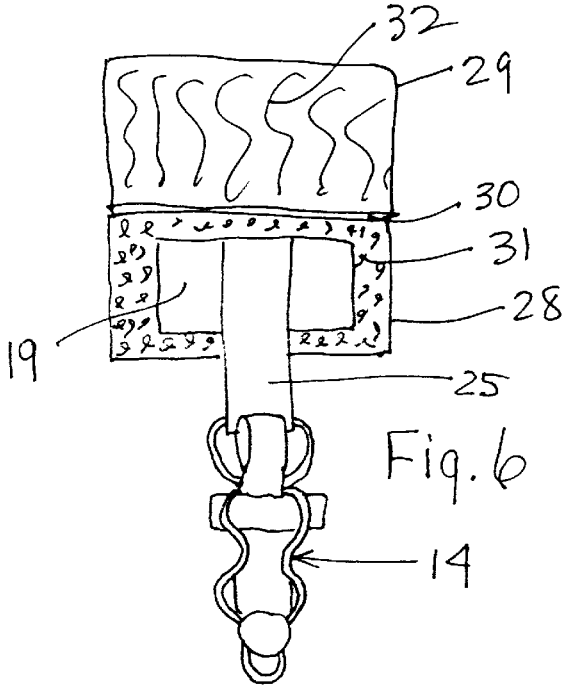
FIG. 6 is a front elevational view of a hockey sock connection device selectively connected to the attachment member of FIGS. 4 and 5.

FIG. 6 shows attachment of a second attachment member to the embodiment of FIGS. 4 and 5. As shown, the flap 29 is raised, and the second attachment end of the attachment member 12, and specifically the Velcro material 20 is connected with the Velcro material 31. Preferably, the size of the backing material 19 is less than the Velcro material 31 so that when the flap or cover 29 is lowered, it is secured to the portion of the Velcro material 31 outside the backing material 19.

Figure 7:
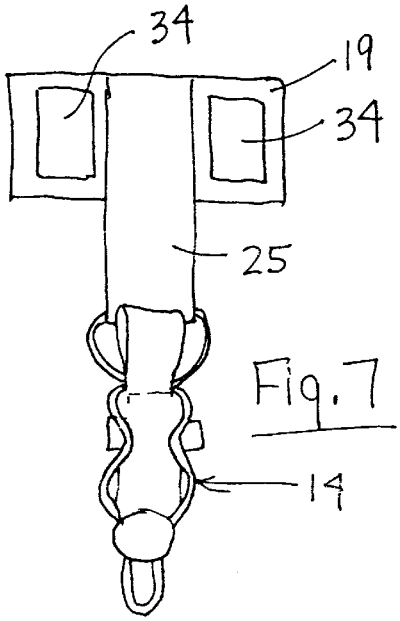
FIG. 7 is a front elevational view of a further embodiment of a hockey sock attachment device.

FIG. 7 shows a further embodiment of a second attachment member. The embodiment of FIG. 7 is similar to that of FIG. 2, except that the exterior surface of the backing material 19 is provided with one or more patches of Velcro or other hook and loop connecting material 34. This embodiment is useful with an attachment member 26 such as that shown in FIGS. 4 and 5. When used with such embodiment, the Velcro patches 34 assist in holding the flap 29 against the backing material 19.

FIG. 8 shows application of the present invention to a pair of hockey shorts 11 to hold up a pair of hockey socks 13.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

I claim:

1. An attachment device for connecting a hockey sock to a hockey short of the type having a first attachment member comprised of one half of a hook and loop connection material, said attachment device comprising:

a second attachment member comprised of one half of a hook and loop connection material complementary to the hook and loop material of said first attachment member, said second attachment member selectively connectable to the first attachment member of the hockey short;

a hockey sock connection member selectively connectable to and disconnectable from a hockey sock; and an elastic connection link having a first end connected in fixed relationship to said second attachment member and a second end connected in fixed, non-sliding relationship to said hockey sock connection member.

2. The attachment device of claim 1 wherein said hockey sock connection member comprises a garter clip.

3. A hockey sock attachment system comprising:

a hockey short;

a first attachment member fixed to said hockey short and a hockey sock attachment device comprising:

a second attachment member selectively connectable to said first attachment member;

a hockey sock connection member selectively connectable to a hockey sock; and a separate connection link having a first end connected in fixed relationship to said second attachment member and a second end connected in fixed, non-sliding relationship to said hockey sock connection member.

4. The hockey sock attachment system of claim 3 wherein said connection link is constructed of an elastic material.

5. The hockey sock attachment system of claim 4 wherein the first attachment member has an attachment surface comprised of one half of a hoop and loop connection material and said second attachment member has an attachment surface comprised of the other one half of said hook and loop connection material.

6. The hockey sock attachment system of claim 5 wherein said hockey sock connection member comprises a garter clip.

7. The hockey sock attachment system of claim 3 wherein the first attachment member has an attachment surface comprised of one half of a hoop and loop connection material and said second attachment member has an attachment surface comprised of the other one half of said hook and loop connection material.

8. The hockey sock attachment system of claim 7 including a flap overlaying said first attachment member and fixed to said hockey short along one edge.

9. The hockey sock attachment system of claim 8 wherein said flap has a flap attachment surface comprised of said other one half of said hook and loop connection material.

10. The hockey sock attachment system of claim 9 wherein the attachment surface of said first attachment member is larger than the attachment surface of said second attachment member.

11. The hockey sock attachment system of claim 10 wherein said flap attachment surface has a flap surface area, said flap surface area being larger than the attachment surface of said second attachment member.

12. A hockey sock attachment clip comprising:

a first attachment member comprising one half of a hook and loop connection material;

a second attachment member comprising a garter clip; and an elastic connection link having a first end connected to said first attachment member in fixed relationship and a second end connected to said second attachment member in fixed, non-sliding relationship.

* * * * *